US011526105B2

(12) United States Patent
Furukawa

(10) Patent No.: US 11,526,105 B2
(45) Date of Patent: Dec. 13, 2022

(54) THERMAL FIXING DEVICE INCLUDING FIXATION BELT AND ELECTROGRAPHIC IMAGE FORMING APPARATUS

(71) Applicant: Oki Electric Industry Co., Ltd., Tokyo (JP)

(72) Inventor: Takaaki Furukawa, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/403,288

(22) Filed: Aug. 16, 2021

(65) Prior Publication Data

US 2022/0100135 A1 Mar. 31, 2022

(30) Foreign Application Priority Data

Sep. 29, 2020 (JP) ..... JP2020-162847

(51) Int. Cl.
*G03G 15/20* (2006.01)

(52) U.S. Cl.
CPC ..... *G03G 15/2057* (2013.01); *G03G 15/2064* (2013.01)

(58) Field of Classification Search
USPC ..... 399/328
See application file for complete search history.

(56) References Cited

U.S. PATENT DOCUMENTS 5,939,337 A * 8/1999 Hatakeyama ..... H05B 6/145 442/16
2011/0305473 A1 12/2011 Tamaki
2014/0199101 A1 7/2014 Miki et al.
2015/0104228 A1 4/2015 Moriguchi
2020/0004184 A1 1/2020 Takazawa
2020/0209788 A1 7/2020 Mochizuki et al.

FOREIGN PATENT DOCUMENTS

JP 2015-118255 A 6/2015

* cited by examiner

*Primary Examiner* — Quana Grainger
(74) *Attorney, Agent, or Firm* — Rabin & Berdo, P.C.

(57) ABSTRACT

A fixing device includes: an annular belt including an elastic layer formed of elastic material and a surface layer formed on a surface of the elastic layer, the annular belt having an internal diameter r [μm]; and a pressing member that makes contact with the surface layer of the annular belt, thereby forming a nip region, wherein $$t_x \cdot \frac{W}{r} \leq 245\ \mu\text{m}$$

is satisfied, where $t_x$ [μm] denotes a thickness of the annular belt and W [μm] denotes a nip width of the nip region in a short-side direction of the nip region, the short-side direction being orthogonal to both a width direction and a thickness direction of the annular belt.

18 Claims, 10 Drawing Sheets

THERMAL FIXING DEVICE INCLUDING FIXATION BELT AND ELECTROGRAPHIC IMAGE FORMING APPARATUS

BACKGROUND OF THE INVENTION

1. Field of the Invention

The disclosure relates to an image forming apparatus of the electrophotographic type, and in particular, to a fixing device of the thermal type including a fixation belt.

2. Description of the Related Art

A fixation belt used for a conventional fixing device of the thermal type is generally formed with three layers: a surface layer, a rubber layer and a base member layer. In cases where high-speed printing is executed, it is necessary to reduce the thickness of the surface layer in order to increase the thermal conductivity of the fixation belt. Further, it is necessary to increase the thickness of the rubber layer in order to secure high print quality (PQ). Thus, in conventional image forming apparatuses capable of high-speed printing, a fixation belt in which the surface layer is thin and the rubber layer is thick is used. See Japanese Patent Application Publication No. 2015-118255 (page 7, FIG. 3), for example.

However, if a fixation belt having a great rubber thickness is used for an image forming apparatus, there is a problem in that the surface layer cracks, which reduces print quality.

SUMMARY OF THE INVENTION

A fixing device of the disclosure includes: an annular belt including an elastic layer formed of elastic material and a surface layer formed on a surface of the elastic layer, the annular belt having an internal diameter r [μm]; and a pressing member that makes contact with the surface layer of the annular belt, thereby forming a nip region, wherein $$t_x \cdot \frac{W}{r} \leq 245\ \mu\text{m}$$

is satisfied, where $t_x$ [μm] denotes a thickness of the annular belt and W [μm] denotes a nip width of the nip region in a short-side direction of the nip region, the short-side direction being orthogonal to both a width direction and a thickness direction of the annular belt.

According to the disclosure, an image forming apparatus inhibiting the cracking of the surface layer caused by the occurrence of wrinkles and excelling in print quality can be provided by setting the thickness $t_x$ of the annular belt as the fixation belt to satisfy a prescribed inequality.

BRIEF DESCRIPTION OF THE DRAWINGS

In the drawings,

FIGS. 11A and 11B are explanatory diagrams schematically showing an S4-S4 cross section (see FIG. 4) of a prescribed part (which can be referred to as a nip corresponding part) of the fixation belt that shifts to a nip state in a nip region, wherein FIG. 11A shows the shape of the part in a non-nipping time (in a natural state) in which the part is in an arc-like shape, and FIG. 11B shows the shape of the part in a nipping time in which the part is deformed to a substantially planar shape;

DETAILED DESCRIPTION OF THE INVENTION (Image Forming Apparatus)

Figure 1:
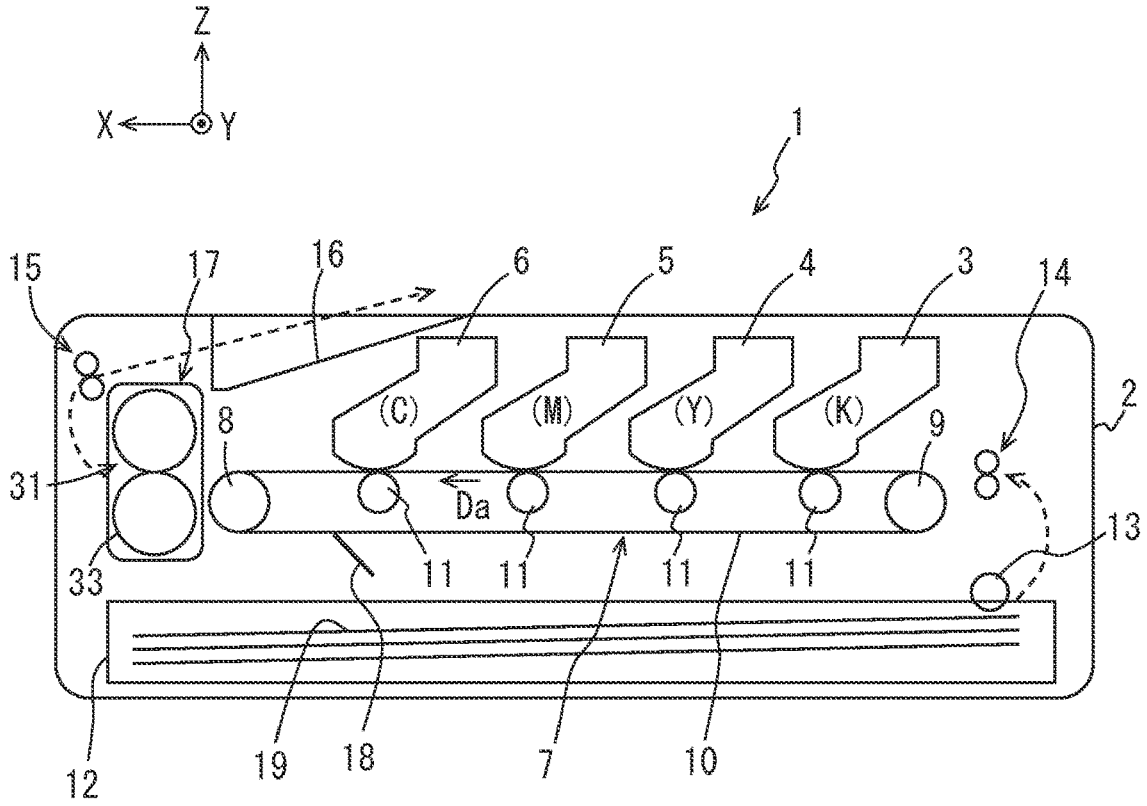
FIG. 1 is a principal part configuration diagram of an image forming apparatus including a fixing device according to an embodiment.
Figure 2:
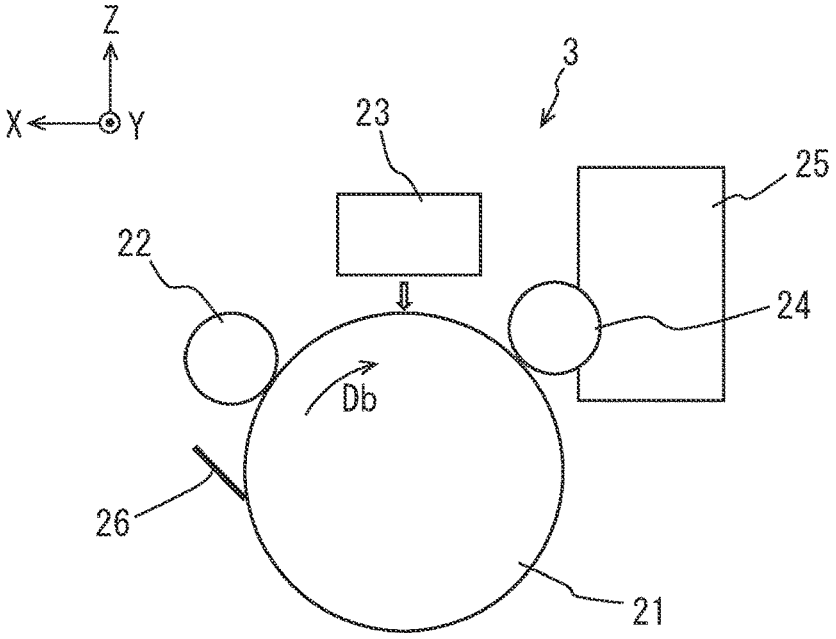
FIG. 2 is a principal part configuration diagram of the image forming unit of FIG. 1.

FIG. 1 is a principal part configuration diagram of an image forming apparatus 1 including a fixing device 17, and FIG. 2 is a principal part configuration diagram of an image forming unit 3.

Referring to FIG. 1, inside a housing 2 of the image forming apparatus 1, a sheet feed cassette 12 storing recording sheets 19 as record media is attached, and a hopping roller 13 for extracting the recording sheet 19 from the sheet feed cassette 12 and a registration roller pair 14 for correcting the skewing of the recording sheet 19 and conveying the recording sheet 19 to an image forming unit are arranged. In the housing 2, image forming units 3 to 6 for forming toner images of black (K), yellow (Y), magenta (M) and cyan (C) colors as image forming sections are successively arranged from an upstream side along a conveyance path of the recording sheet 19 conveyed in the direction of the arrow Da.

These image forming units 3 to 6 have the same configuration except in that each image forming unit 3-6 uses a toner of a prescribed color. Thus, the configuration of each image forming unit will be described here with reference to FIG. 2 by taking the image forming unit 3 of black (K) as an example.

The image forming unit 3 includes a photosensitive drum 21 as an image carrier, a charging roller 22 as a charging device, a development roller 24 as a developing agent carrier, a toner cartridge 25 as a developing agent storage section for storing a toner, a cleaning blade 26, and so forth.

In an upper part of each image forming unit 3-6, an LED head 23 as an exposure device is arranged corresponding to the photosensitive drum 21 as shown in FIG. 2, and a transfer unit 7 (FIG. 1) is arranged under the image forming units 3 to 6.

The transfer unit 7 includes a drive roller 8, a driven roller 9 arranged at a prescribed distance from the drive roller 8, a transfer belt 10 that is stretched and driven by the drive roller 8 and the driven roller 9 and travels in the direction of the arrow Da, transfer rollers 11 as transfer members arranged to respectively face the photosensitive drums 21 of the image forming units 3 to 6 via the transfer belt 10, and a cleaning blade 18 as a cleaning member arranged with its edge (front end) in contact with the transfer belt 10.

Incidentally, as for the X, Y and Z-axes of the XYZ orthogonal coordinate system in FIG. 1, the X-axis is taken in a conveyance direction in which the recording sheet 19 passes through the image forming units 3 to 6, the Y-axis is taken in a rotation axis direction of the photosensitive drums 21, and the Z-axis is taken in a direction orthogonal to these two axes. When the X, Y and Z-axes are shown in subsequent drawings, the directions of these X, Y and Z-axes are assumed to represent directions common to the drawings. Namely, the X, Y and Z-axes in each drawing indicate an arrangement direction of the part drawn in the drawing when the part constitutes a part of the image forming apparatus 1 shown in FIG. 1. Further, it is assumed here that the image forming apparatus 1 is arranged so that the Z-axis is substantially in the vertical direction.

The cleaning blade 18 is arranged to scrape off toners that have adhered to the transfer belt 10 from the photosensitive drums 21 (FIG. 2). In the sheet conveyance direction, the fixing device 17 is arranged after the transfer unit 7. As will be described later, the fixing device 17 includes a fixation belt unit 31 and a pressure roller 33 as a pressing member. A conveyance roller pair 15 conveys the recording sheet 19, on which the toner image has been fixed by the fixing device 17, to an ejection roller pair (not shown) and ejects the recording sheet 19 onto a stacker 16 arranged outside the housing 2. Incidentally, the fixing device 17 will be described in detail later.

Based on the above-described configuration, an outline of a print operation executed by the image forming apparatus 1 will be described below.

When the hopping roller 13 arranged at a front end of the sheet feed cassette 12 is rotated, the recording sheets 19 in the sheet feed cassette 12 are fed sheet by sheet in the direction of the arrow (dot line) and sent to the registration roller pair 14. This registration roller pair 14 corrects the skewing of the recording sheet 19 by temporarily stopping the recording sheet 19 fed thereto, and sends the recording sheet 19 to a position between the photosensitive drum 21 (FIG. 2) of the image forming unit 3 rotating in the direction of the arrow Db and the transfer belt 10 traveling in the direction of the arrow Da.

Meanwhile, in each image forming unit 3, 4, 5, 6, the surface of the photosensitive drum 21 (FIG. 2) is electrically charged uniformly by the charging roller 22 and the surface is selectively exposed to light by a light-emitting element of the LED head 23, by which an electrostatic latent image as a latent image is formed. In FIG. 2, the toner stored in the toner cartridge 25 is supplied to the development roller 24 by a toner supply roller (not shown), formed by a development blade (not shown) into a thin layer on the surface of the development roller 24, and thereafter adheres to the electrostatic latent image. By this operation, the toner image as a developing agent image is formed on the photosensitive drum 21.

The recording sheet 19 sent from the registration roller pair 14 is conveyed successively between the photosensitive drums 21 of the image forming units 3 to 6 and the transfer rollers 11 according to the traveling of the transfer belt 10. At that time, voltage of a polarity opposite to that of the toner image is applied to each transfer roller 11 and the toner image of each color on the photosensitive drum 21 of each image forming unit 3-6 is successively transferred by electrostatic force onto the recording sheet 19 in an overlaying manner, by which a color toner image is formed on the recording sheet 19.

Thereafter, the recording sheet 19 is sent to the fixing device 17, the color toner image is fixed on the recording sheet 19 by heat applied by the fixation belt unit 31 and pressure applied by the pressure roller 33, and thereafter the recording sheet 19 is conveyed further by the conveyance roller pair 15 and is ejected onto the stacker 16 outside the housing 2 by the ejection roller pair not shown.

Incidentally, even after the toner image on the photosensitive drum 21 is transferred onto the recording sheet 19, the toner remaining not transferred adheres to, i.e., remains on, the surface of the photosensitive drum 21; however, the residual toner remaining on the surface of the photosensitive drum 21 is scraped off and removed by the cleaning blade 26 (FIG. 2) according to the rotation of the photosensitive drum 21.

(Fixing Device)

Figure 3:
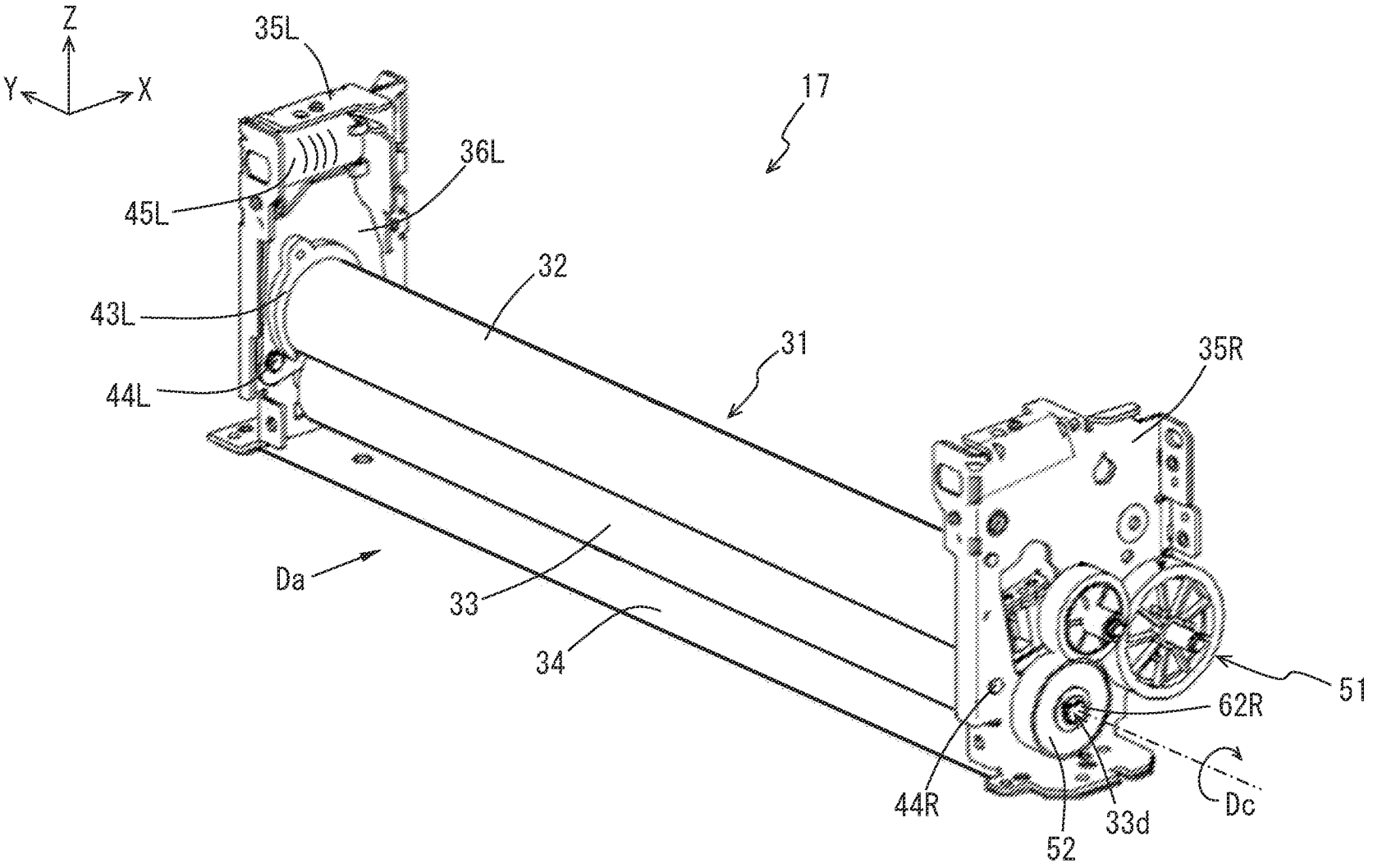
FIG. 3 is an external perspective view showing the internal configuration of the fixing device of FIG. 17.
Figure 4A:
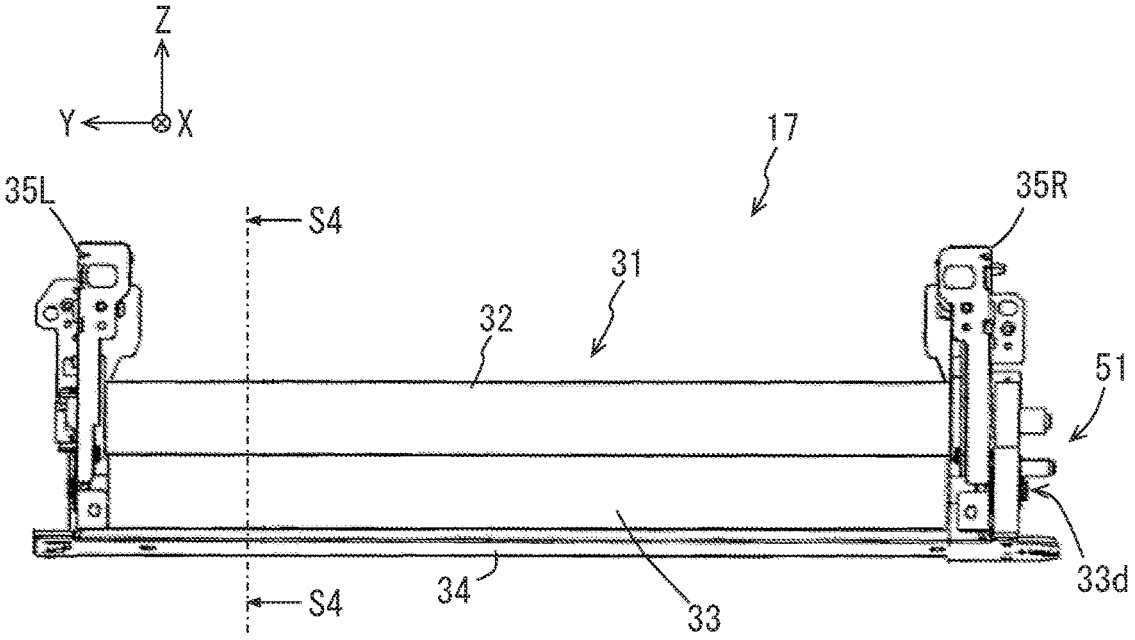
FIG. 4A is a front view of the fixing device as viewed from an upstream side in a sheet conveyance direction (i.e., a direction of the arrow Da)
Figure 4B:
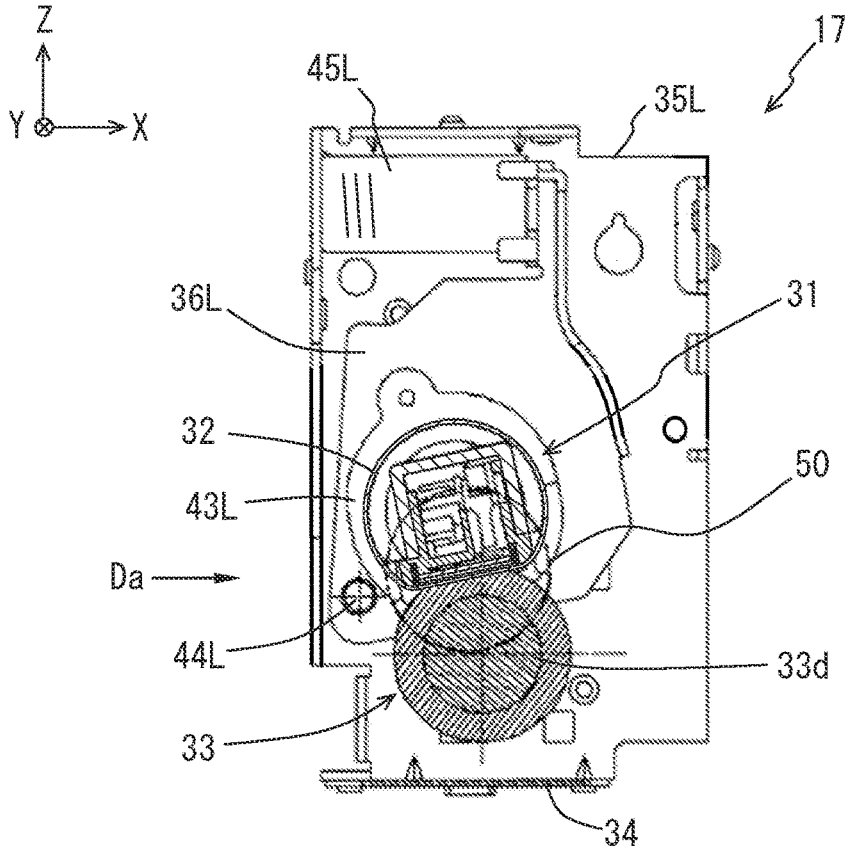
FIG. 4B is a cross-sectional view taken along a line S4-S4 in FIG. 4A.
Figure 5:
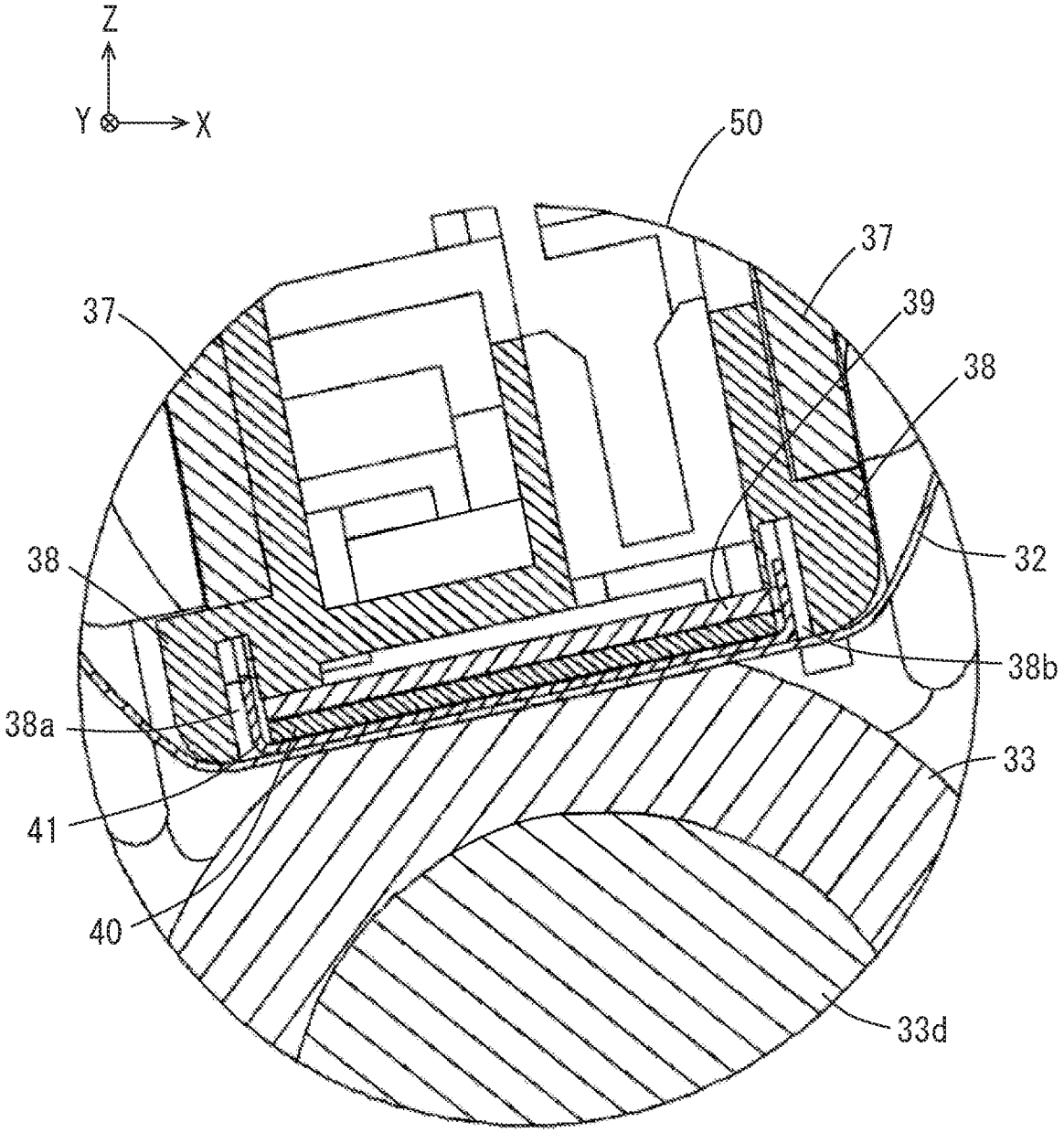
FIG. 5 is a partially enlarged view of a part surrounded by a dot line circle in FIG. 4B.
Figure 6:
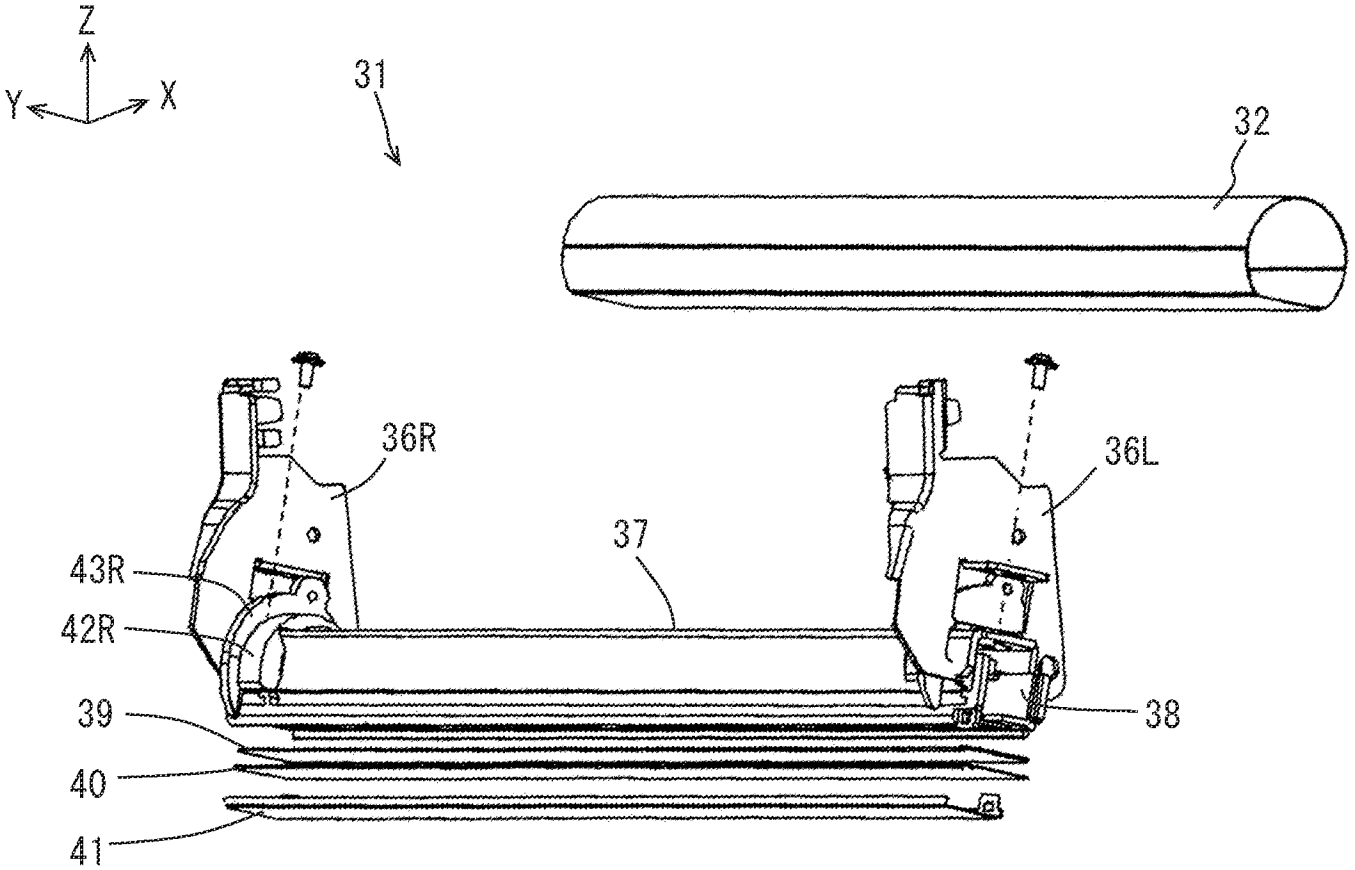
FIG. 6 is an exploded perspective view of a fixation belt unit of the fixing device shown in FIG. 3 as viewed from a direction different from that in FIG. 3.

Next, the configuration of the fixing device 17 will be described below. FIG. 3 is an external perspective view showing the internal configuration of the fixing device 17, FIG. 4A is a front view of the fixing device 17 as viewed from the upstream side in the sheet conveyance direction (the direction of the arrow Da), and FIG. 4B is a cross-sectional view taken along the line S4-S4 in FIG. 4A. FIG. 5 is a partially enlarged view of the part 50 surrounded by the dot line circle in FIG. 4B, and FIG. 6 is an exploded perspective view of the fixation belt unit 31 of the fixing device 17 shown in FIG. 3 as viewed from a direction different from that in FIG. 3. Incidentally, there will be cases where a direction leftward/rightward, upward/downward or forward/backward from the fixing device 17 is specified as viewed in the sheet conveyance direction (the direction of the arrow Da).

The fixing device 17 includes a lower frame 34 extending in a lengthwise direction of the fixing device 17 (i.e., Y-axis direction, which can also be referred to as a transverse width direction or a width direction of the fixation belt 32) and a left side frame 35L and a right side frame 35R arranged to orthogonally extend from left and right end parts of the lower frame 34 and to face each other. These frames are formed integrally. The lower frame 34, the left side frame 35L and the right side frame 35R correspond to a frame section.

The pressure roller 33 is rotatably held by the left side frame 35L and the right side frame 35R at both end parts of a metallic shaft 33*d* as a rotary shaft of the pressure roller 33, and is arranged in the lengthwise direction of the fixing device 17. A right small-diameter part 62R (see FIG. 9A)

situated in a right end part of the metallic shaft 33*d* extends to the outside of the right side frame 35R, to which a driven gear 52 is attached integrally. On the outside of the right side frame 35R, a drive gear train 51 engaging with the driven gear 52 is arranged, transmits turning force received from a non-illustrated drive source to the driven gear 52, and rotates the pressure roller 33 in a direction of the arrow Dc as needed.

As shown in FIG. 6, the fixation belt unit 31 includes a stay 37 extending in the lengthwise direction of the fixation belt unit 31 (Y-axis direction), a left lever 36L and a right lever 36R screwed and fixed to left and right end parts of the stay 37 and arranged to face each other, a left regulatory plate 43L (FIG. 3) and a right regulatory plate 43R arranged between the stay 37 and the left and right levers 36, and a fixation belt 32 as an endless annular belt. The stay 37 is provided with a holding member 38 fitted onto a lower part of the stay 37, extending in parallel with the stay 37, and holding a heat storage plate 39, a heater 40 and a heat diffusion member 41 similarly extending in parallel with the stay 37 in a successively stacked state.

Incidentally, in regard to the heat storage plate 39, the heater 40 and the heat diffusion member 41, there are cases where a direction in which each member extends is referred to as the lengthwise direction and a direction along a flat plate part of each member and orthogonal to the lengthwise direction is referred to as a short-side direction. Namely, the short-side direction is orthogonal to both a width direction and a thickness direction of the annular belt 32.

As shown in FIGS. 5 and 6, the heat diffusion member 41 is formed with a metallic plate whose both end parts in the short-side direction are bent like a square U shape to face each other, and a front regulatory groove 38*a* and a rear regulatory groove 38*b* in which the bent both end parts of the heat diffusion member 41 can be fit are formed in the lengthwise direction on the holding member 38.

The heat diffusion member 41 is placed in a state in which the heat storage plate 39 and the heater 40 are sandwiched between the heat diffusion member 41 and the holding member 38, the bent both end parts of the heat diffusion member 41 are fit in the front regulatory groove 38*a* and the rear regulatory groove 38*b*, and the heat diffusion member 41 is in contact with an inner side of the attached fixation belt 32 in a cylindrical shape as will be described later (see FIG. 5). In this case, the heat storage plate 39 and the heater 40 are in a state of being sandwiched between the holding member 38 and the heat diffusion member 41 and being free in the vertical direction.

Thermally conductive grease is applied between the heater 40 and the heat storage plate 39 and between the heater 40 and the heat diffusion member 41 in order to efficiently transmit the heat from the heater 40. Looseness for enabling movement in the vertical direction is left between the front and rear regulatory grooves 38*a* and 38*b* of the holding member 38 and the bent both end parts of the heat diffusion member 41 fit in the front and rear regulatory grooves 38*a* and 38*b*. The heat diffusion member 41 is a metallic plate made of stainless steel, aluminum alloy, iron or the like, and a slide surface of the heat diffusion member 41 facing the fixation belt 32 is provided with a coating of low friction and high wear resistance such as a glass coating or hard chrome plating as will be described later.

Before the left and right levers 36L and 36R are screwed to the stay 37, the fixation belt 32 is attached so that the stay 37 and the holding member 38 into which the heat diffusion member 41 has been fit are stored inside the fixation belt 32. The fixation belt 32 is slidably held, with the inner side of its both end parts contacting and being guided by a left arc-shaped guide 42L (not shown) and a right arc-shaped guide 42R (FIG. 6) formed in both end parts of the stay 37, and movement of the fixation belt 32 to the left and right is also restricted by the left and right regulatory plates 43L and 43R at the stage when the left and right levers 36 have been screwed to the stay 37 via the left and right regulatory plates 43L and 43R.

Incidentally, there are also cases where the fixation belt unit 31 is configured to include no heat storage plate 39. Further, there are also cases where the thermally conductive grease is not applied between the heat storage plate 39 and the heater 40. Furthermore, in this example, slide grease is applied to the heat diffusion member 41 and a slide part of the fixation belt 32 to realize high slidability and prevent the frictional wear.

The fixation belt unit 31 configured as above is rotatably held by the left and right side frames 35L and 35R arranged to face each other. Specifically, the left lever 36L of the fixation belt unit 31 is held by a rotary bearing 44L to be rotable with respect to the left side frame 35L, and the right lever 36R of the fixation belt unit 31 is held by a rotary bearing 44R to be rotable with respect to the right side frame 35R.

With this configuration, the whole of the fixation belt unit 31 is held to be rotatable around a rotary shaft in the lengthwise direction including the rotary bearings 44L and 44R, and further, the fixation belt 32 is biased to be pressed against the pressure roller 33 to form a nip part as shown in FIG. 5 by a left spring 45L set in a compressed state between the left side frame 35L and the left lever 36L and a right spring 45R set in the compressed state between the right side frame 35R and the right lever 36R.

In the fixing device 17 configured as above, when the pressure roller 33 receives turning force supplied from a non-illustrated drive source and rotates in the direction of the arrow Dc, the fixation belt 32 pressing against the pressure roller 33 and forming the nip part rotates together with the pressure roller 33 and conveys the recording sheet 19, being conveyed in the direction of the arrow Da, in the same direction while heating and compressing the recording sheet 19 at the nip part.

(Fixation Belt Unit)

Next, the configuration of the fixation belt unit 31 for heating the recording sheet 19 will be described further.

Figure 7:
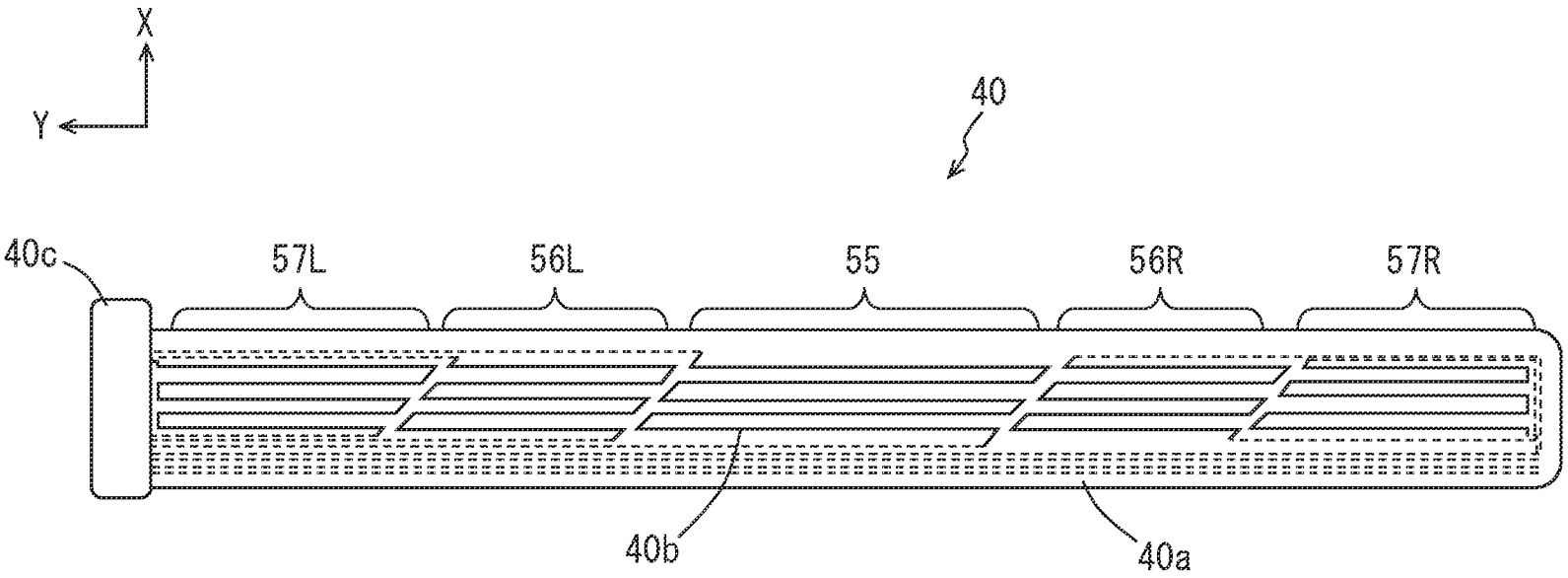
FIG. 7 is a plan view showing the internal configuration of a heater.

FIG. 7 is a plan view showing the internal configuration of the heater 40 (see FIG. 6). As shown in FIG. 7, the heater 40 has a configuration in which a plurality of heating parts are discretely arranged in a lengthwise direction of the heater 40. The heater 40 is provided on an inner surface of the annular belt 32 and includes a plurality of heating parts which are arranged in the width direction of the annular belt 32 (i.e., the lengthwise direction of the heater 40) and spaced apart from each other. The heater 40 in this example includes a main heating part 55, a left intermediate heating part 56L and a right intermediate heating part 56R respectively arranged to the left and right of and adjacently to the main heating part 55, a left end heating part 57L arranged adjacently to the left intermediate heating part 56L, and a right end heating part 57R arranged adjacently to the right intermediate heating part 56R. Incidentally, the main heating part 55, the left intermediate heating part 56L, the right intermediate heating part 56R, the left end heating part 57L and the right end heating part 57R can hereinafter be referred to simply as heating parts 55, 56 and 57 when it is not particularly necessary to discriminate between heating parts.

Each heating part 55, 56, 57 has a configuration in which a heating resistive element 40*b* electrically independent of each other is wired on a common substrate 40*a*, and is configured to be electrically connected to an external drive section via a connection terminal part 40*c* and conductive wiring parts (dotted line parts) connected to the connection terminal part 40*c* and to individually generate heat when a drive current is fed individually to its respective heating resistive element 40*b*.

In regard to the heating parts 55, 56 and 57 discretely arranged, a heating range is controlled depending on a sheet width and an arrangement direction of the recording sheet 19 to be printed on. The heating part(s) to be energized to generate heat is/are selected depending on the sheet used, such as energizing only the main heating part 55 at the center to generate heat when the printing is performed on a sheet having a narrow width such as a postcard and energizing all the heating parts 55, 56 and 57 to generate heat when the printing is performed on a sheet having or set to have a large width such as a transversely set A4 sheet (longitudinally set A3 sheet), by which wasteful energy consumption is inhibited.

Figure 8:
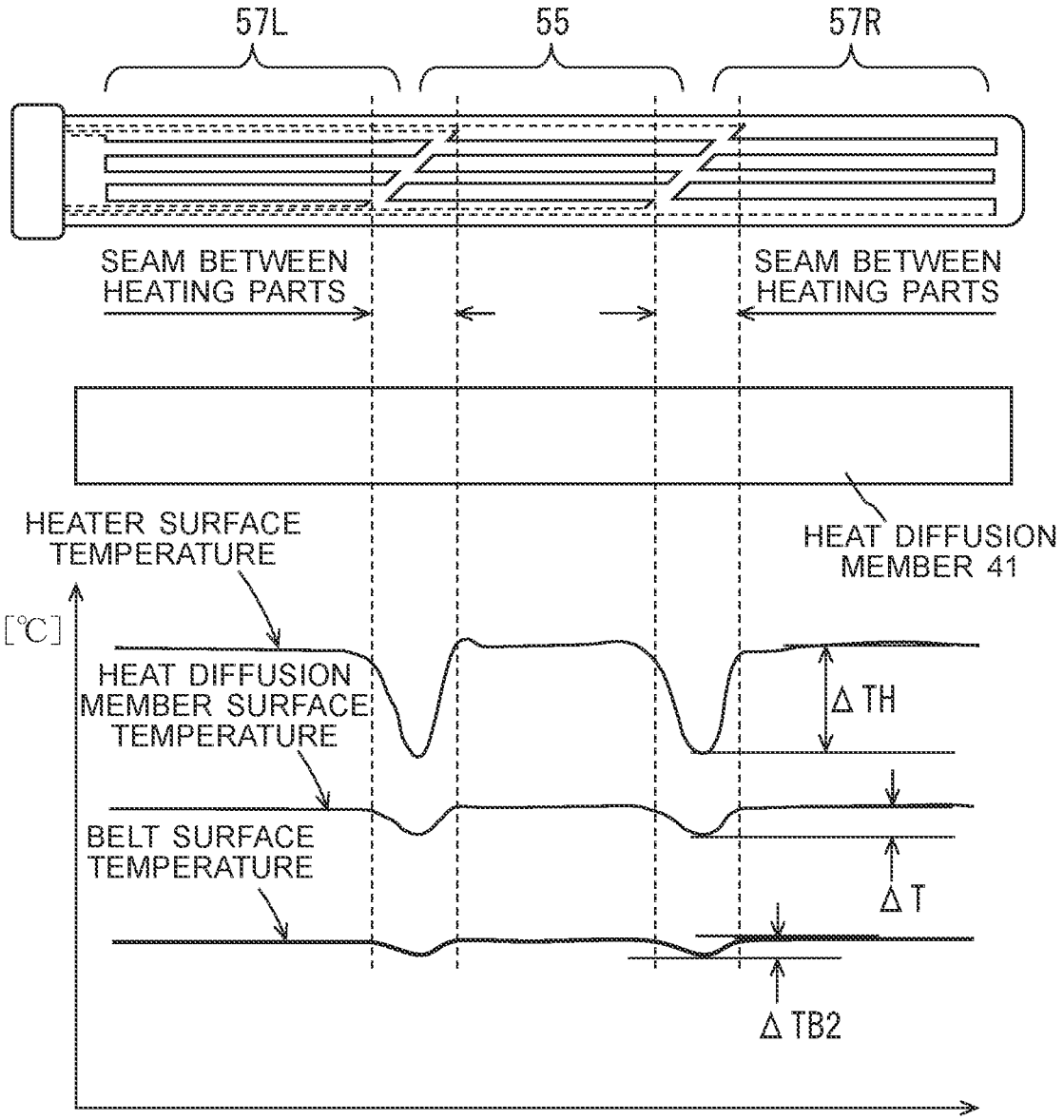
FIG. 8 is a temperature distribution diagram showing surface temperature of the heater, surface temperature distribution in a corresponding part of a heat diffusion member and surface temperature distribution in a corresponding part of a fixation belt when a main heating part and left and right end heating parts of the heater are energized to generate heat in the fixation of a wide recording sheet extending to these heating parts.

FIG. 8 is a temperature distribution diagram showing surface temperature of the heater 40, surface temperature distribution in a corresponding part of the heat diffusion member 41 and surface temperature distribution in a corresponding part of the fixation belt 32 when the main heating part 55 and the left and right end heating parts 57L and 57R of the heater 40 are energized to generate heat in the fixation of a wide recording sheet extending to these heating parts 55, 57L and 57R. Incidentally, the left and right intermediate heating parts 56L and 56R of the heater 40 are left out in this example for the sake of simplicity.

As is clear from this diagram, at each seam between heating parts, the surface temperature of the heater 40 drops and a temperature level difference ΔTH occurs. However, a temperature level difference ΔTB2 in the state in which the heater 40 provided with the heat diffusion member 41 is suppressed as shown in FIG. 8. As above, it can be understood that providing the heat diffusion member 41 improves even parts of the fixation belt 32 corresponding to the seams between heating parts in terms of the drop in the surface temperature relative to other regions corresponding to the heating parts.

Figure 9A:
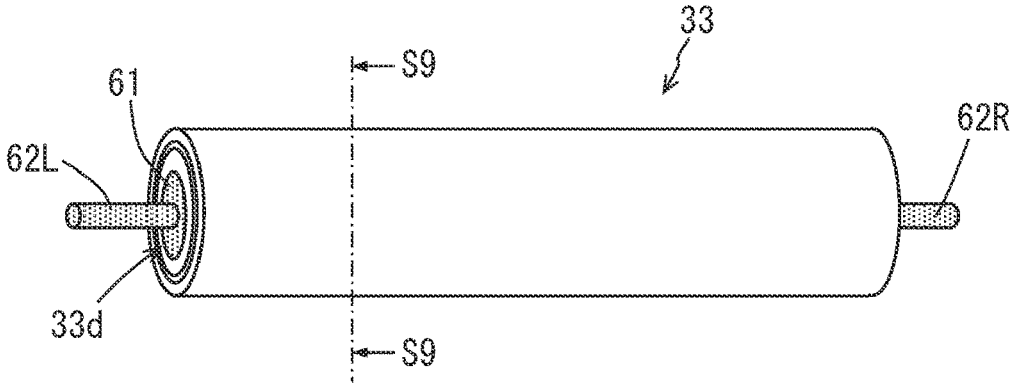
FIG. 9A is a schematic external view of a pressure roller.
Figure 9B:
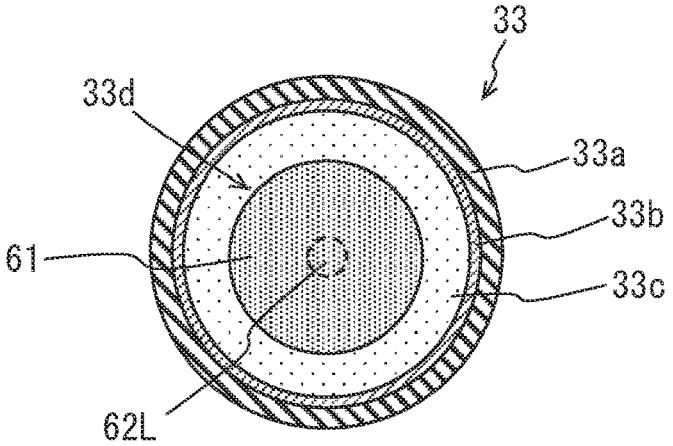
FIG. 9B is a cross-sectional view schematically showing an S9-S9 cross section in FIG. 9A.

FIG. 9A is a schematic external view of the pressure roller 33, and FIG. 9B is a cross-sectional view schematically showing an S9-S9 cross section in FIG. 9A.

As shown in FIGS. 9A and 9B, the pressure roller 33 is formed with at least four materials: an outer circumferential surface layer 33*a* that makes contact with the recording sheet 19, an adhesive layer 33*b* that bonds an elastic layer 33*c* and the outer circumferential surface layer 33*a* together, the elastic layer 33*c* that is formed of rubber or the like and forms the fixation nip, and the metallic shaft 33*d* having sufficient pressure resistance not to be deformed even by the fixation pressure. An adhesive layer may be provided between the metallic shaft 33*d* and the elastic layer 33*c* as needed. As for the specifications of the pressure roller 33 used in this example, the external diameter was 30 [mm], the reverse crown was −0.2 mm, and the product hardness was 50° to 65°. Incidentally, the film thickness of the elastic layer 33*c* in this example was 3 mm. The outer circumferential surface layer 33*a* of the pressure roller 33 slides on the record medium (mainly, paper) and the fixation belt 32. While this outer circumferential surface layer 33*a* is generally desired to be a thin film to be able to follow the deformation of the elastic layer similarly to a surface layer 32*a* of the fixation belt 32, a too thin film leads to wrinkles on the surface caused by the friction with the fixation belt 32 and the friction with the record medium, and thus the film thickness of the outer circumferential surface layer 33*a* is desired to be 15 μm to 50 μm. Further, the outer circumferential surface layer 33*a* is desired to have high releasability to inhibit toners remaining on the fixation belt 32 and paper dust deriving from the recording sheet 19 from sticking to the outer circumferential surface layer 33*a*, in addition to heat resistance to withstand the fixation temperature, and thus material obtained by fluorine substitution is generally used. In this example, a PFA material was selected and a thin film 30 μm thick was formed as the outer circumferential surface layer 33*a*, for example.

The adhesive layer 33*b* of the pressure roller 33 is used for the purpose of bonding the outer circumferential surface layer 33*a* to the elastic layer 33*c* in order to inhibit the peeling of the outer circumferential surface layer 33*a* from the elastic layer 33*c* and the occurrence of wrinkles. In this example, a silicone adhesive agent including an electrically conductive agent as an additive and excelling in adhesivity and heat resistance to the fixation heat was used. The reason for using an adhesive agent having electrical conductivity in this example was to inhibit the accumulation of electric charge in the pressure roller 33 and the electrostatic adhesion of paper dust or the like to the pressure roller 33 at the time of printing. Incidentally, while an adhesive agent having electrical conductivity was used in this example, it is also possible to use an adhesive agent having no electrical conductivity.

The elastic layer 33*c* of the pressure roller 33 needs to have appropriate rubber hardness and an appropriate film thickness in order to form the fixation nip similarly to an elastic layer 32*b* of the fixation belt 32, and needs to be designed also in consideration of heat storage performance for preventing the loss of the heat transmitted from the fixation belt 32 to the developing agents (toners) and the print medium (e.g., recording sheet). While the elastic layer 33*c* may be formed by using solid rubber similarly to the case of the fixation belt 32, silicone sponge including foamed cells was selected in this example as the material of the elastic layer 33*c* for the above-described reasons.

The metallic shaft 33*d* of the pressure roller 33 is formed with a large-diameter part 61 serving as a base for each layer and a left small-diameter part 62L and the right small-diameter part 62R extending to the left and right from the center of the large-diameter part 61. As described earlier, the left small-diameter part 62L is rotatably held by the left side frame 35L, the right small-diameter part 62R is rotatably held by the right side frame 35R, and the driven gear 52 (FIG. 3) is attached to the right small-diameter part 62R. The metallic shaft 33*d* has only to be made of material withstanding the fixation pressure, and especially, the large-diameter part 61 of the metallic shaft 33*d* may be either a solid shaft or a hollow pipe. In this example, a solid SUS304 shaft was used.

Figure 10:
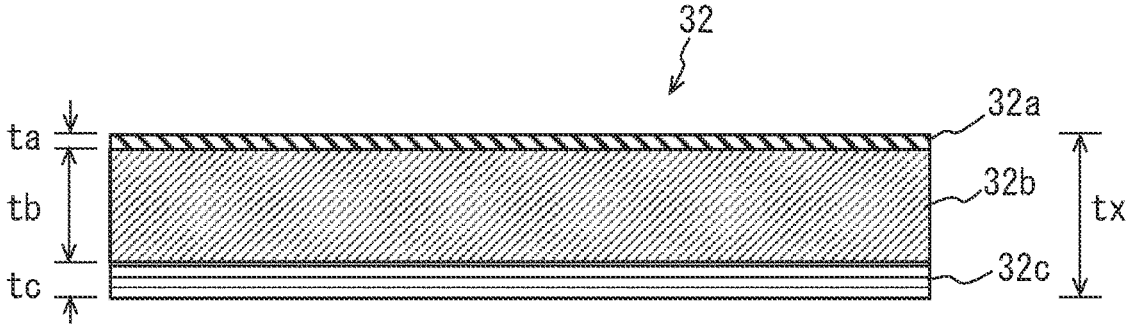
FIG. 10 is a cross-sectional view schematically showing a cross section of the fixation belt.

FIG. 10 is a cross-sectional view schematically showing a cross section of the fixation belt 32. As shown in FIG. 10, the fixation belt 32 is formed with at least three layers: the surface layer 32*a* making contact with the toner image and having sufficient releasability, the elastic layer 32*b* that forms the fixation nip, and a base member layer 32*c* that lets the belt exhibit high durability and high mechanical strength.

While the surface layer 32*a* of the fixation belt 32 is generally desired to be a thin film to be able to follow the deformation of the elastic layer 32*b*, a too thin film leads to wrinkles on the surface layer 32*a* caused by the friction with the pressure roller 33 and the friction with the record medium, and thus the film thickness of the surface layer 32*a* is generally desired to be 10 μm to 50 μm. Further, the surface layer is desired to have high releasability to inhibit the fixed toners from sticking to the surface layer, in addition to heat resistance to withstand the fixation temperature, and thus material obtained by fluorine substitution is generally used. In this example, a PFA material was selected, for example, as the material of the surface layer 32*a*.

The elastic layer 32*b* of the fixation belt 32 needs to have appropriate rubber hardness and an appropriate film thickness in order to form the fixation nip, and needs to inhibit the loss of heat supplied from a heat source provided on an inner surface of the belt and efficiently transmit the heat to an outermost peripheral surface (toner contact surface) of the fixation belt. If the elastic layer 32*b* is thick, a uniform fixation nip is likely to be formed, whereas heat capacity becomes high and heat loss becomes high, and thus a thick elastic layer 32*b* is undesirable in this regard. In consideration of these conditions, a standard film thickness of the elastic layer 32*b* is 50 μm to 500 μm. Further, the rubber hardness of the elastic layer 32*b* is desired to be 10° to 60° in order to increase the uniformity of the fixation nip.

Thus, in this example, silicone rubber having heat resistance to withstand the fixation temperature was selected as the material of the elastic layer 32*b*. Incidentally, the elastic material used for the elastic layer is not limited to silicone rubber; any material withstanding the fixation temperature is usable, such as fluororubber or the like, for example.

The base member layer 32*c* of the fixation belt 32 needs to have a configuration having high mechanical strength and excelling in durability against repetitive bending and buckling in order to enable the fixation belt 32 to travel without tearing until the end of its operating life. Thus, in this example, a polyimide (PI) layer 30 mm in the external diameter and 80 μm in the film thickness was selected as the base member layer 32*c*.

The material and the film thickness of the base member layer 32*c* are not limited to this example; it is permissible if the base member layer 32*c* has heat resistance to withstand the fixation temperature, sufficient buckling strength and a Young's modulus of prescribed strength. For example, SUS, polyether ether ketone (PEEK)-based material or the like is usable, and when using a resin material, filler such as PTFE or boron nitride is added as needed in order to increase the slidability and the thermal conductivity. Further, to let the base member layer 32*c* exhibit electrical conductivity, material to which electrically conductive filler including carbon black or a metallic element such as zinc has been added is used.

Here, the relationship between high-speed printing and PFA cracking of the surface layer 32*a* of the fixation belt 32, e.g., a PFA layer using a PFA material in this example, will be discussed further.

In a case where high-speed printing is executed, it is necessary to reduce the thickness of the PFA layer (the surface layer 32*a*) in order to increase the thermal conductivity of the fixation belt 32. Further, in order to prevent the occurrence of dapples, it is necessary to increase the thickness of a rubber layer by using the elastic layer 32*b*, i.e., silicone rubber in this example. However, if the PFA thickness is reduced and further the rubber layer (the elastic layer 32*b*) is thickened, the PFA cracking occurs and a black horizontal streak occurs to the printed image. The dapples mentioned here correspond to a situation in which the fixation belt 32 cannot sufficiently follow concave parts on the surface of the record medium, pressure becomes insufficient, toners in the concave parts are not smoothed down, and low-gloss parts occur to the printed image.

In a case where high-speed printing is executed, the time for which the print medium is nipped by the fixation belt 32 and the pressure roller 33 becomes short. To secure satisfactory fixation, it is necessary to supply the record medium with a necessary amount of heat in a short time, and thus the thermal conductivity of the fixation belt 32 has to be increased. In this case, the thermal conductivity of the fixation belt 32 can be increased by reducing the thickness of PFA having poor thermal conductivity; however, the reduction in the thickness of the PFA layer (the surface layer 32*a*) leads to lower strength of the PFA layer, and PFA becomes more likely to crack.

On the other hand, to prevent the occurrence of dapples, it is necessary to increase the thickness of the rubber layer (the elastic layer 32*b*) so as to apply uniform pressure even to the concave parts of the record medium. However, if the rubber layer is made too thick, the depth of the wrinkles occurring to PFA of the PFA layer (the surface layer 32*a*) of the fixation belt 32 at the nip position between the fixation belt 32 and the pressure roller 33 increases and that causes the PFA cracking.

Since the fixation belt 32 is in a cylindrical shape, its outer circumferential length is greater than its inner circumferential length; however, the fixation belt 32 at the nip part is compressed by the pressure roller 33 and partially shifts to a state close to a plane. At that time, the apparent outer circumferential length, shrinking in a circumferential direction of the nip part, becomes substantially equal to the inner circumferential length, and this shrinkage of the outer circumferential length is considered to be caused by the occurrence of wrinkles on the surface of the PFA layer.

Since the amount of the shrinkage of the outer circumferential length at the nip position (i.e., a circumferential direction distance on the surface of the PFA layer that turns into wrinkles, hereinafter referred to as a change amount) increases with the increase in the rubber thickness of the elastic layer 32*b* (rubber layer), the depth of the PFA wrinkles in a nipping time, i.e., at the time of nipping, increases with the increase in the rubber thickness. If shearing force due to the sheet feed of the record medium is applied to the PFA layer (the surface layer 32*a*) when the PFA wrinkles are deep, the PFA cracking occurs at a position where the wrinkle is the deepest (a side farther from the pressure roller 33). At the position where PFA cracked, the pressure in the nipping time changes, by which the black horizontal streak (dark line orthogonal to the medium feed direction) occurs to the printed image and becomes visually recognizable.

Next, the change amount (shrinkage amount) Z of the fixation belt 32 at the nip position will be represented by a mathematical expression, and further, a condition in which the PFA cracking does not occur will be prescribed.

Figure 11A:
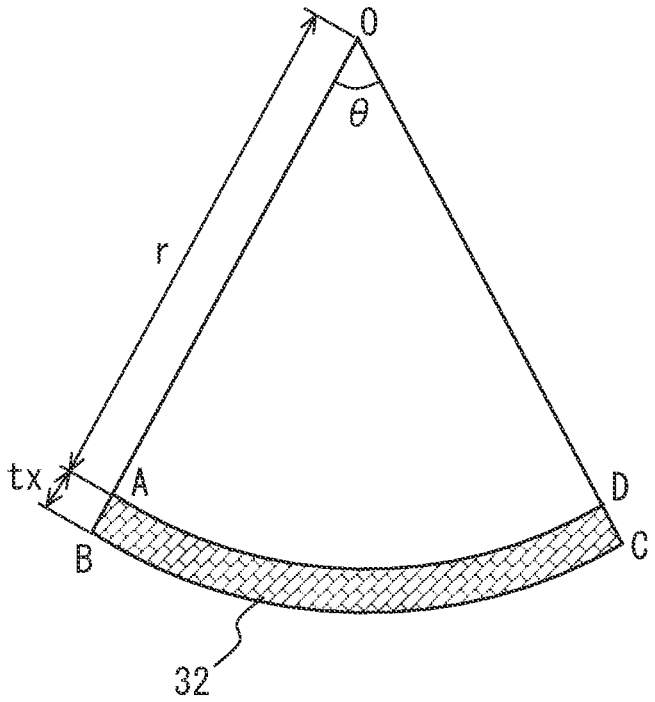
Figure 11B:
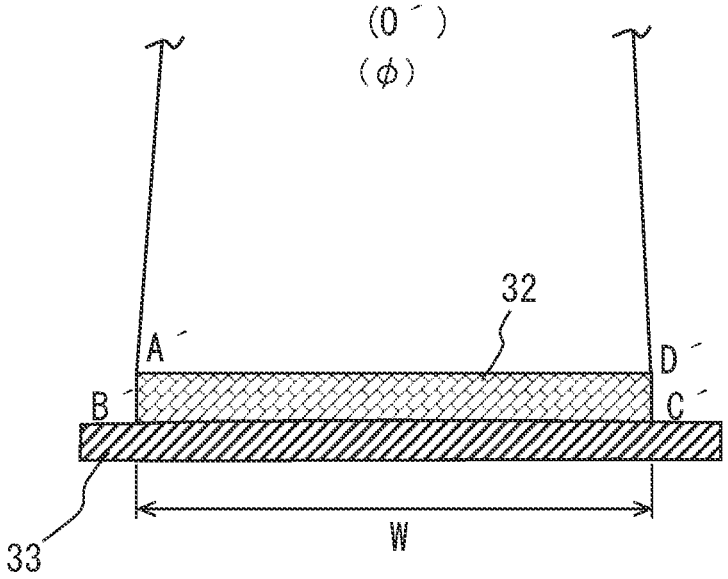

FIGS. 11A and 11B are explanatory diagrams schematically showing the S4-S4 cross section (see FIG. 4) of a prescribed part (which can be referred to as a nip corresponding part) of the fixation belt 32 that shifts to a nip state in a nip region, wherein FIG. 11A shows the shape of the part in a non-nipping time (in a natural state) in which the part is in an arc-like shape and FIG. 11B shows the shape of the part in the nipping time in which the part is deformed to a substantially planar shape.

In the state in which the fixation belt 32 is not nipping, the change amount (shrinkage amount) Z at the nip position equals 0, and thus "the length of the arc of the annular belt corresponding to the nip region in the non-nipping state (outer circumference in the non-nipping time which will be described later)" is the length of the arc BC in FIG. 11A. In contrast, "the length of the arc of the annular belt corresponding to the nip region in the nipping state (outer circumference in the nipping time which will be described later)" is the length of the arc B'C' in FIG. 11B.

Here, "the length of the arc of the annular belt corresponding to the nip region in the non-nipping state" is represented by the sum of "the length of the arc of the annular belt corresponding to the nip region in the nipping state" and "the change amount (shrinkage amount) Z at the nip position". Thus, "the change amount (shrinkage amount) Z at the nip position" can be obtained by calculating the difference between "the length of the arc of the annular belt corresponding to the nip region in the non-nipping state (arc BC)" and "the length of the arc of the annular belt corresponding to the nip region in the nipping state (arc B'C')". In the following, $$Z=\text{arc } BC-\text{arc } B'C'$$

will be calculated.

Here, dimensions and an angle of each part will be described.

The thickness $t_x$ of the fixation belt 32 is as follows:

$$t_x=(t_a+t_b+t_c)$$

where $t_a$ represents the thickness of the surface layer 32*a* (PFA layer), $t_b$ represents the thickness of the elastic layer 32*b* (rubber layer) and $t_c$ represents the thickness of the base member layer 32*c* (see FIG. 10).

As shown in FIG. 11A, in regard to the nip corresponding part of the fixation belt 32 in the non-nipping time, inner circumference ends are represented as A and D, outer circumference ends are represented as B and C, and an arc center is represented as O, and as shown in FIG. 11B, in regard to the nip corresponding part of the fixation belt 32 in the nipping time, inner circumference ends are represented as A' and D', outer circumference ends are represented as B' and C', and an arc center is represented as O'. Further, the following dimensions and angles are defined:

r [μm]: the internal radius of the fixation belt 32 in the non-nipping time

θ [rad]: the central angle ∠AOD of the fixation belt 32 in the non-nipping time (rad: dimensionless number represented by length/length)

R [μm]: the internal diameter radius of the fixation belt 32 in the nipping time ϕ[rad]: the central angle (∠A'O'D') of the fixation belt 32 in the nipping time (rad: dimensionless number represented by length/length)

W [μm]: the nip width in the circumferential direction

Therefore, in the nip corresponding part, the internal radius r in the non-nipping time is r=OA=OD, the internal radius R in the nipping time is R=O'A'=O'D', the belt thickness $t_x$ in the non-nipping time is $t_x$=AB=DC, the belt thickness $t_x$ in the nipping time is $t_x$=A'B'=D'C', the length of the inner circumference in the non-nipping time is arc AD=2πr×θ/2π=rθ, the length of the inner circumference in the nipping time is arc A'D'=2πR×θ/2π=Rθ, the length of the outer circumference in the non-nipping time is arc BC=2π(r+$t_x$)×θ/2π=(r+$t_x$)θ, and the length of the outer circumference in the nipping time is arc B'C'=2π(R+$t_x$) ×ϕ/2π=(R+$t_x$)ϕ.

Here, the base member layer 32*c* formed with polyimide (PI) on the inner circumferential surface of the fixation belt 32 (arc AD and arc A'D' in FIGS. 11A and 11B) has high mechanical strength and no wrinkles occur, and thus the length of the inner circumference (arc AD) in the non-nipping time and the length of the inner circumference (arc A'D') in the nipping time in the nip corresponding part are equal to each other. This can be represented by the following expression (1):

$$r\theta=R\phi \quad (1).$$

Since the nip width in the circumferential direction is W, the following expression holds:

straight line A'D'=W.

Since the nip corresponding part is in a substantially planar shape in the nip state, the following expression is considered to hold:

arc A'D'=straight line A'D'=W.

Since the length of the inner circumference (arc AD) in the non-nipping time and the length of the inner circumference (arc A'D') in the nipping time in the nip corresponding part are equal to each other as mentioned above, the following expression holds:

arc AD=arc A'D'=straight line A'D'=W=rθ.

Accordingly, the following expression (2) is obtained:

$$\theta=\frac{W}{r}. \quad (2)$$

Based on the above expressions, the change amount (shrinkage amount) Z as the cause of the shrinks is represented as follows:

$$Z=\text{arc } BC-\text{arc } B'C'=(r+t_x)\theta-(R+t_x)\phi=t_x(\theta-\phi)+(r\theta-R\phi).$$

Based on this expression and the aforementioned expression (1), Z is represented as follows:

$$Z=t_x(\theta-\phi)(\theta>\phi).$$

Based on this expression and the aforementioned expression (2), Z is represented as the following expression (3):

$$Z=t_x\cdot\left(\frac{W}{r}-\phi\right)=(t_a+t_b+t_c)\cdot\left(\frac{W}{r}-\phi\right). \quad (3)$$

Therefore, the change amount (shrinkage amount) Z increases and decreases proportionally to the belt thickness $t_x$ (=$t_a$+$t_b$+$t_c$). The change amount (shrinkage amount) Z increases with the decrease in the central angle ϕ of the fixation belt 32 in the nipping time, and increases with the decrease in the internal radius r of the fixation belt 32 in the non-nipping time. In other words, the expression (3) indicates that the change amount (shrinkage amount) Z of the surface layer of the fixation belt cannot be suppressed without setting the belt thickness $t_x$ the nip width W and the internal radius r of the fixation belt in appropriate ranges.

As will be described later, tests in this example were conducted in a case where the nip region was in a planar shape (ϕ=0) so that the change amount (shrinkage amount) Z takes on the maximum value (condition in which wrinkles are the most likely to occur to the surface layer 32*a*). When the nip region is in a planar shape, the expression (3) turns into $$Z = (t_a + t_b + t_c) \cdot \frac{W}{r},$$

and thus the relationship
"(belt thickness $t_x$)
×(nip width W/fixation belt internal radius r)"
plays an important role in the change amount (i.e., shrinkage amount) Z.

Next, a numerical value of the change amount (shrinkage amount) Z at which the PFA cracking is caused by the wrinkles will be discerned through tests, and appropriate ranges of the thickness of the surface layer 32*a* and the thickness of the elastic layer 32*b* will be set.

For this purpose, a description will be given here of a fixation belt PFA cracking test conducted for determining the conditions of the fixation belt 32 employed for the fixing device 17 according to the embodiment by preparing a fixation belt unit testing machine 100 (FIG. 12) having a configuration similar to the fixing device 17 shown in FIG. 3 and allowing for attachment and removal of the fixation belt 32, nip pressure setting and flexible setting of the revolution speed of the pressure roller 33 and a plurality of test fixation belts 32' differing in specifications as test samples. Incidentally, each test fixation belt 32' prepared here is the same as the fixation belt 32 in the basic shape, whereas the thickness $t_a$ of the surface layer 32*a* and the thickness $t_b$ of the elastic layer 32*b* in the test fixation belt 32' are not fixed at particular values as will be described later.

Figure 12:
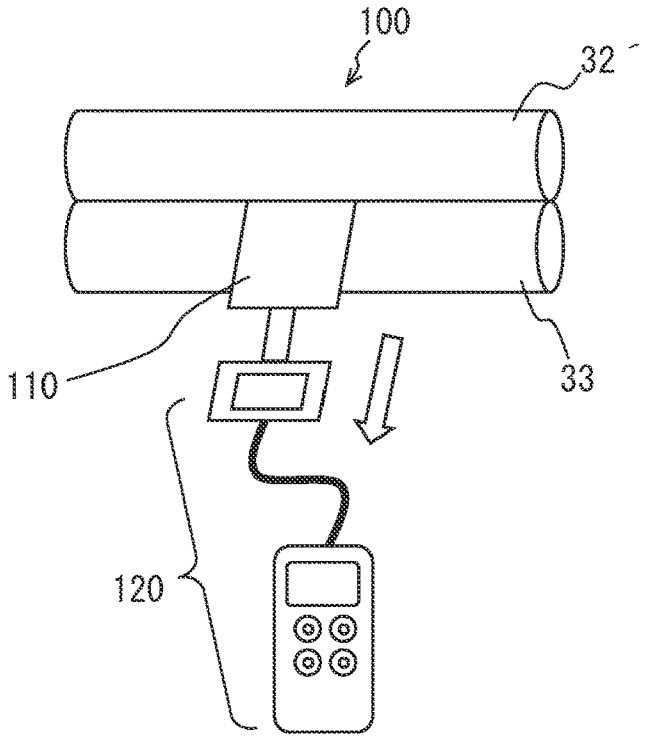
FIG. 12 is a schematic test explanatory diagram for explaining an outline of a fixation belt PFA cracking test.

FIG. 12 is a schematic test explanatory diagram for explaining an outline of the fixation belt PFA cracking test. As shown in FIG. 12, the fixation belt unit testing machine 100 includes the pressure roller 33 and the test fixation belt 32' as the test sample set on the testing machine, and these components have been adjusted to a prescribed nip pressure.

The fixation belt PFA cracking test is conducted according to the following steps (P1) to (P7):

(P1) Set the fixation belt 32 on the fixation belt unit testing machine 100.

(P2) Place a strip 110 (width: 30 mm, length: 297 mm) of CC250 (Color Copy 250 g/m$^2$, product code: GAAA6605) as a thick paper medium so that its central part is situated at the nip center position.

(P3) Connect a digital force gauge 120 (manufactured by IMADA Co., Ltd., serial No.: 130842, model: ZPS) to the front end of the strip of CC250. At that time, adjust the height of placing the digital force gauge 120 so that CC250 becomes in parallel with the nip region (nip width W).

(P4) Hold the digital force gauge 120 in hand, extract the strip 110 from the nip position in the direction of the arrow in FIG. 12 at a speed of 100 mm/s, and adjust the nip pressure so that the extracting force at that time equals 40 N (although the extracting force in the image forming apparatus 1 is 37 N, the test was conducted in a condition that was 3 N higher than the actual condition). At that time, the pressure roller 33 was set in a rotation stop state.

(P5) Set the test fixation belt 32' and the strip 110 on the fixation belt unit testing machine 100 in the same way, and extract the strip 110 under the same nip pressure and at the same speed 100 mm/s.

(P6) After the extraction, make the test evaluation by checking the presence/absence of a PFA crack (visual check is possible, looks like a crack) on the surface of the test fixation belt 32'. Incidentally, when the visual check is difficult, the check may be conducted by using an electron microscope or the like.

(P7) Repeat the test evaluation according to the steps (P5) and (P6) for each of the plurality of types of test fixation belts 32' differing in the thickness $t_a$ of the surface layer 32*a* and the thickness $t_b$ of the elastic layer 32*b*.

The other test conditions were as follows:

The setting range of the thickness $t_a$ of the surface layer 32*a* was set as 9 μm≤$t_a$≤20 μm.

This is because $t_a$ less than 9 μm leads to deterioration in the strength of the surface layer 32*a* and the occurrence of surface cracking and $t_a$ exceeding 20 μm leads to deterioration in the thermal conductivity to the medium and deterioration in fixability (i.e., high fixation temperature).

The setting range of the thickness $t_b$ of the elastic layer 32*b* was set as 150 μm≤$t_b$.

This is because $t_b$ less than 150 μm leads to deterioration in medium trackability and the occurrence of defective printing (gloss unevenness like dapples).

While the thickness $t_c$ of the base member layer 32*c* was set at 80 μm, the thickness $t_c$ can be set in a range of 20 μm≤$t_c$≤200 μm. This is because $t_c$ less than 20 μm leads to deterioration in the durability of the test fixation belt 32' and $t_c$ exceeding 200 μm leads to low thermal conductivity and a too long rising time.

While the nip width W in the circumferential direction was set at 10500 μm, the nip width W can be set in a range of 4000 μm≤W≤40000 μm. This is because the nip width W less than 4000 μm leads to a too short nip time and the occurrence of defective fixation and the nip width W exceeding 40000 μm leads to too wide dispersion of the nip pressure and the occurrence of defective fixation.

While the internal radius r of the test fixation belt 32' in the non-nipping time was set at 15000 μm, the internal radius r can be set in a range of 4000 μm≤r≤40000 μm. This is because setting the internal radius r less than 4000 μm is difficult in terms of the structure of the fixing device and the internal radius r exceeding 40000 μm leads to an increase in the amount of heat necessary until the fixation becomes possible and a too long waiting time until the printing becomes possible after turning on the power.

While the rubber hardness of the elastic layer 32*b* was set at 20°, the rubber hardness is desired to be in a range of 10° to 40°.

The calculations were performed on the assumption that ϕ=0 since the nip region is like a plane in the nipping time.

Table 1 lists the specifications and evaluation results of seventeen types of test fixation belts 32' No. 1 to No. 17 prepared as the test samples of the fixation belt PFA cracking test by variously setting the thickness $t_a$ of the surface layer 32*a* and the thickness $t_b$ of the elastic layer 32*b* under the above-described test conditions. Evaluation criteria were as follows:

"○ (circle mark)": No occurrence of PFA cracking.

"Δ (triangle mark)": Occurrence of a horizontal streak (having no influence on printing) to the test fixation belt 32' even though PFA cracking did not occur.

"X (cross mark)": Occurrence of PFA cracking

TABLE 1

| Sample No. | THICKNESS $t_b$ OF ELASTIC LAYER 32b [μm] | THICKNESS $t_a$ OF SURFACE LAYER 32a [μm] | EVALUATION OF PFA CRACKING | SHRINKAGE AMOUNT Z [μm] |
|---|---|---|---|---|
| 1 | 250 | 20 | ○ | 245 |
| 2 | 200 | 20 | ○ | 210 |
| 3 | 150 | 20 | ○ | 175 |
| 4 | 300 | 15 | × | 276.5 |
| 5 | 250 | 15 | ○ | 241.5 |
| 6 | 225 | 15 | ○ | 224 |
| 7 | 200 | 15 | ○ | 206.5 |
| 8 | 300 | 12 | × | 274.4 |
| 9 | 250 | 12 | ○ | 239.4 |
| 10 | 225 | 12 | ○ | 221.9 |
| 11 | 200 | 12 | ○ | 204.4 |
| 12 | 150 | 12 | ○ | 169.4 |
| 13 | 300 | 9 | × | 272.3 |
| 14 | 250 | 9 | Δ | 237.3 |
| 15 | 225 | 9 | ○ | 219.8 |
| 16 | 200 | 9 | ○ | 202.3 |
| 17 | 150 | 9 | ○ | 167.3 |

$t_c$ = 80 μm,
r = 15000 μm,
W = 10500 μm

Figure 13:
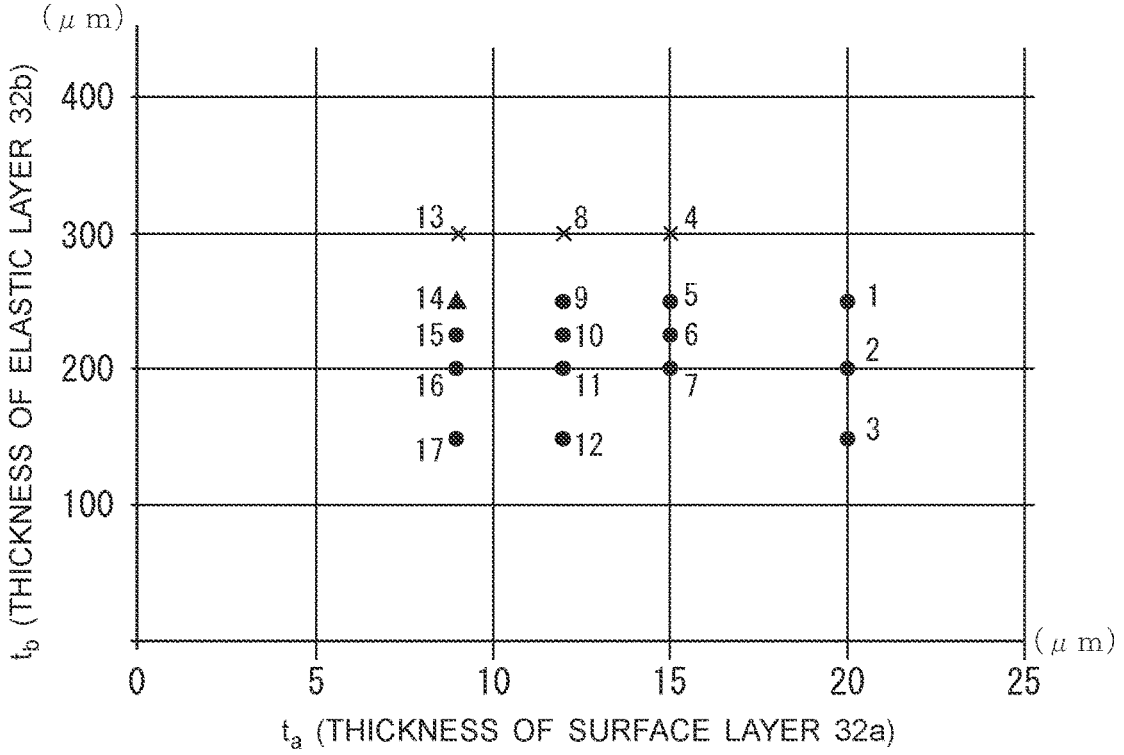
FIG. 13 is a diagram summarizing results of measurement of samples No. 1 to No. 17 shown in Table 1 in the form of a graph by plotting the results on the graph having a vertical axis representing the thickness $t_b$ of an elastic layer and a horizontal axis representing the thickness $t_a$ of a surface layer.

FIG. 13 is a diagram summarizing the results of the measurement of the samples No. 1 to No. 17 shown in Table 1 in the form of a graph by plotting the results on the graph having a vertical axis representing the thickness $t_b$ of the elastic layer 32*b* and a horizontal axis representing the thickness $t_a$ of the surface layer 32*a*. The explanation will be given further with reference to FIG. 13.

From Table 1 and the graph in FIG. 13, it was found that the PFA cracking due to the shrinkage for the change amount (shrinkage amount) Z does not occur if the change amount (shrinkage amount) Z [μm] as the cause of the wrinkles satisfies the following condition:

$$Z = t_x \cdot \frac{W}{r} = (t_a + t_b + t_c) \cdot \frac{W}{r} \leq 245\ \mu\text{m}. \quad (4)$$

Further, in order to prevent the occurrence of the PFA cracking under the conditions of 9 μm≤$t_a$≤20 μm, 150 μm≤$t_b$, $t_c$=80 μm, W=10500 μm, r=15000 μm and ϕ=0, the thickness $t_a$ and the thickness $t_b$ are set to satisfy the following relationship:

$$t_b\ [\mu\text{m}] \leq 270 - t_a\ [\mu\text{m}].$$

Incidentally, the check in the test was made for a range up to $t_b$≤250 μm.

Further, in order to suppress also the precursor (occurrence of the horizontal streak on the belt) of the PFA cracking, based on Table 1 and the graph in FIG. 13, the following two cases are desirable:

a first case satisfying

12 μm≤$t_a$≤20 μm and 225 μm≤$t_b$≤250 μm, and a second case satisfying

9 μm≤$t_a$≤20 μm and 150 μm≤$t_b$≤225 μm.

Accordingly, among the seventeen types of test fixation belts 32' No. 1 to No. 17 prepared as the test samples shown in Table 1, the samples No. 1 to No. 3, No. 5 to No. 7, No. 8 to No. 12 and No. 15 to No. 17 correspond to the fixation belt 32 according to this embodiment.

Here, a description will be given of an example of a method of identifying the PFA of the surface layer (PFA layer) 32*a* of the fixation belt 32.

The surface of the surface layer 32*a* is thinly scraped off by using a razor or the like, the scraped material is combusted at a temperature of 590° C. for 0.2 minutes by using a pyrolyzer, and thereafter the combusted material is analyzed by gas chromatography mass spectrometry. If PFA, ethylene tetrafluoride or perfluoro alkoxy ethylene is detected by the analysis, the surface layer (PFA layer) 32*a* of the fixation belt 32 can be identified as a PFA layer.

Next, a description will be given of an example of actually measuring the central angle ϕ in the nipping time. Incidentally, in this actual measurement method, an actual fixing device is mounted on a testing machine and the measurement is performed in the nip state of the actual fixing device.

For example, the test fixation belt 32' is mounted on the fixation belt unit testing machine 100, the test fixation belt 32' is set in the nip state, an image of the nip state at that time is captured by using a camera, image analysis is performed on the captured image, and the position (locus) of the nip part is represented by an approximation formula $y=f(t_x)$.

Subsequently, the curvature radius R of the nip part at a point $A(t_a, f(t_a))$ is obtained by using the following expression:

$$R = \frac{(1 + f'(t_a)^2)^{3/2}}{|f''(t_a)|},$$

and from the curvature radius R and the nip width W, the central angle ϕ of the nip part (at the point A) can be obtained as ϕ=W/R. Incidentally, when $y=f''(t_x)=0$, the curvature radius is regarded as ∞.

Incidentally, while a PFA material was employed as the surface layer of the fixation belt 32 in this embodiment, the embodiment is not limited to this example; it is also possible to employ a different material having sufficient heat resistance to withstand the fixation temperature and excellent releasability to inhibit the fixed toners from sticking thereto.

Further, while the evaluation in the test in this embodiment was performed in the condition in which the rubber hardness of the elastic layer 32*b* equals 20° as an example, it was confirmed that wrinkles occur to the surface layer of the fixation belt 32 also in evaluation performed throughout the range 10° to 40° of the rubber hardness of the elastic layer 32*b*.

As described above, with the fixing device according to this embodiment, a fixing device capable of inhibiting the PFA cracking of the surface layer 32*a* can be provided by forming the fixation belt 32 to satisfy the aforementioned expression (4) under prescribed conditions.

In other words, in detail, since the plurality of heating parts 57L, 56L, 55, 56R, 57R are arranged in the width direction (Y) of the fixation belt 32 and spaced apart from each other, the temperature of the fixation belt 32 at a position corresponding to each seam between the heating parts 57L, 56L, 55, 56R, 57R is a little lower than that at a position corresponding to each of the heating parts 57L, 56L, 55, 56R, 57R. Namely, a little difference of the rubber hardness of the elastic layer 32*b* occurs between the position corresponding to each seam between the heating parts 57L, 56L, 55, 56R, 57R and the position corresponding to each of the heating parts 57L, 56L, 55, 56R, 57R. Specifically, the elastic layer 32*b* at the position corresponding to each seam between the heating parts 57L, 56L, 55, 56R, 57R is slightly harder than that at the position corresponding to each of the heating parts 57L, 56L, 55, 56R, 57R. Therefore, the surface layer cracking that is more likely to occur due to the difference of the rubber hardness of the elastic layer of the elastic layer 32*b* of the fixation belt 32 can be prevented from occurring by the fixation belt 32 satisfying the aforementioned expression (4).

While an example of applying the embodiments to an image forming apparatus as a color printer was described in the above embodiment, the embodiments are not limited to this example; the embodiments are applicable also to other types of image forming apparatuses such as a copy machine, a facsimile machine and a multifunction peripheral (MFP). Further, while the above description was given of a color printer, the embodiments are applicable also to a monochrome printer.

DESCRIPTION OF REFERENCE CHARACTERS

1: image forming apparatus, 2: housing, 3: image forming unit, 4: image forming unit, 5: image forming unit, 6: image forming unit, 7: transfer unit, 8: drive roller, 9: driven roller, 10: transfer belt, 11: transfer roller, 12: sheet feed cassette, 13: hopping roller, 14: registration roller pair, 15: conveyance roller pair, 16: stacker, 17: fixing device, 18: cleaning blade, 19: recording sheet, 21: photosensitive drum, 22: charging roller, 23: LED head, 24: development roller, 25: toner cartridge, 26: cleaning blade, 31: fixation belt unit, 32: fixation belt, 32*a*: surface layer, 32*b*: elastic layer, 32*c*: base member layer, 33: pressure roller, 33*a*: outer circumferential surface layer, 33*b*: adhesive layer, 33*c*: elastic layer, 33*d*: metallic shaft, 34: lower frame, 35L: left side frame, 35R right side frame, 36L: left lever, 36R: right lever, 37: stay, 38: holding member, 38*a*: front regulatory groove, 38*b*: rear regulatory groove, 39: heat storage plate, 40: heater, 40*a*: substrate, 40*b*: heating resistive element, 40*c*: connection terminal part, 41: heat diffusion member, 42L: left arc-shaped guide, 42R: right arc-shaped guide, 43L: left regulatory plate, 43R: right regulatory plate, 44L: rotary bearing, 44R: rotary bearing, 45L: left spring, 45R: right spring, 51: drive gear train, 52: driven gear, 55: main heating part, 56L: left intermediate heating part, 56R: right intermediate heating part, 57L: left end heating part, 57R: right end heating part, 61: large-diameter part, 62L: left small-diameter part, 62R: right small-diameter part, 100: fixation belt unit testing machine, 110: strip, 120: digital force gauge.

What is claimed is:

1. A fixing device comprising:

an annular belt including an elastic layer formed of elastic material and a surface layer formed on a surface of the elastic layer, the annular belt having an internal radius r [μm];

a pressing member configured to contact the surface layer of the annular belt, thereby forming a nip region with the annular belt; and a heater that is provided on an inner circumferential surface of the annular belt and heats the nip region, wherein $$t_x \cdot \frac{W}{r} \leq 245\ \mu m$$

and $$9\ \mu m \leq t_a \leq 20\ \mu m$$

are satisfied, where $t_x$ [μm] denotes a thickness of the annular belt, $t_a$ [μm] denotes a thickness of the surface layer and W [μm] denotes a nip width of the nip region in a short-side direction of the nip region, the short-side direction being orthogonal to both a width direction and a thickness direction of the annular belt.

2. The fixing device according to claim 1, wherein $$150\ \mu m \leq t_b$$

are satisfied, where $t_b$ [μm] denotes a thickness of the elastic layer.

3. The fixing device according to claim 1, wherein the annular belt further includes a base member layer joined to another surface of the elastic layer on a side opposite to the surface layer, the base member layer having a thickness $t_c$ [μm].

4. The fixing device according to claim 3, wherein the base member layer has a thickness $t_c$ [μm] and the elastic layer has a thickness $t_b$ [μm], and $t_b$ is set to satisfy $t_b \leq 250$ μm when $t_c = 80$ μm.

5. The fixing device according to claim 1, wherein $$t_x \cdot \left(\frac{W}{r} - \phi\right) \leq 245\ \mu m$$

is satisfied, where ϕ [rad] denotes a central angle formed by an arc of a virtual circle at a center thereof, the virtual circle having a radius of the annular belt while the nipping region is formed, the arc having the same length as the nip width of the nip region.

6. The fixing device according to claim 1, wherein rubber hardness of the elastic layer is in a range of 10° to 40°.

7. The fixing device according to claim 1, wherein the surface layer is made of a material having heat resistance to withstand a fixation temperature.

8. The fixing device according to claim 1, further comprising:

a heater provided on an inner surface of the annular belt and including a plurality of heating parts which are arranged in the width direction of the annular belt and spaced apart from each other.

9. An image forming apparatus comprising the fixing device according to claim 1.

10. The fixing device according to claim 1, wherein $$150\ \mu m \leq t_b \leq 250\ \mu m$$

is satisfied, where $t_b$ [μm] denotes a thickness of the elastic layer.

11. The fixing device according to claim 1, wherein the annular belt further includes a base member layer joined to another surface of the elastic layer on a side opposite to the surface layer, the base member layer having a thickness $t_c$ [μm], the base member layer being a layer made of resin material.

12. The fixing device according to claim 11, wherein the resin material is heat resistance material.

13. The fixing device according to claim 11, wherein the resin material is polyimide.

14. The fixing device according to claim 1, wherein the heater includes a heat diffusion member in direct contact with the inner circumferential surface of the annular belt, and a plurality of heating resistive elements, each of which individually generates heat.

15. A fixing device, comprising:

an annular belt including an elastic layer formed of elastic material and a surface layer formed on a surface of the elastic layer, the annular belt having an internal radius r [μm];

a pressing member configured to contact the surface layer of the annular belt, thereby forming a nip region with the annular belt; and a heater that is provided on an inner circumferential surface of the annular belt and heats the nip region, wherein $$t_x \cdot \frac{W}{r} \leq 245\ \mu m,$$

$$9\ \mu m \leq t_a \leq 20\ \mu m, \text{ and}$$

$$150\ \mu m \leq t_b \leq 250\ \mu m$$

are satisfied, where $t_x$ [μm] denotes a thickness of the annular belt, $t_a$ [μm] denotes a thickness of the surface layer, $t_b$ [μm] denotes a thickness of the elastic layer and W [μm] denotes a nip width of the nip region in a short-side direction of the nip region, the short-side direction being orthogonal to both a width direction and a thickness direction of the annular belt.

16. An image forming apparatus comprising the fixing device according to claim 15.

17. A fixing device, comprising:

an annular belt including an elastic layer formed of elastic material and a surface layer formed on a surface of the elastic layer, and a polyimide layer joined to another surface of the elastic layer on a side opposite to the surface layer, the annular belt having an internal radius r [μm];

a pressing member configured to contact the surface layer of the annular belt, thereby forming a nip region with the annular belt; and a heater that is provided on an inner circumferential surface of the annular belt and heats the nip region, wherein $$t_x \cdot \frac{W}{r} \leq 245\ \mu m$$

and $$9\ \mu m \leq t_a \leq 20\ \mu m$$

are satisfied, where $t_x$ [μm] denotes a thickness of the annular belt, $t_a$ [μm] denotes a thickness of the surface layer and W [μm] denotes a nip width of the nip region in a short-side direction of the nip region, the short-side direction being orthogonal to both a width direction and a thickness direction of the annular belt.

18. An image forming apparatus comprising the fixing device according to claim 17.

* * * * *